US006565332B2

(12) United States Patent
Kawahara et al.

(10) Patent No.: US 6,565,332 B2
(45) Date of Patent: May 20, 2003

(54) LINEAR COMPRESSOR

(75) Inventors: Sadao Kawahara, Shiga (JP); Teruyuki Akazawa, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/874,269

(22) Filed: Jun. 6, 2001

(65) Prior Publication Data

US 2001/0055535 A1 Dec. 27, 2001

(30) Foreign Application Priority Data

Jun. 19, 2000 (JP) ..... 2000-183238

(51) Int. Cl.[7] ..... F04B 17/04; F04B 35/04
(52) U.S. Cl. ..... 417/417; 417/363
(58) Field of Search ..... 417/417, 416, 417/415, 418, 552, 545, 550, 312, 363, 547; 60/517, 520; 92/84, 110, 113, 114, 130 R, 131

(56) References Cited

U.S. PATENT DOCUMENTS 5,492,313 A * 2/1996 Pan et al. ..... 267/161
5,920,133 A * 7/1999 Penswick et al. ..... 310/17
5,993,178 A * 11/1999 Park et al. ..... 417/545
6,077,054 A * 6/2000 Lee et al. ..... 417/417
6,084,320 A * 7/2000 Morita et al. ..... 310/12
6,089,352 A * 7/2000 Kim et al. ..... 184/6.16
6,494,293 B1 * 12/2002 Jung ..... 184/6.16

FOREIGN PATENT DOCUMENTS

JP 10197081 A * 7/1998

* cited by examiner

*Primary Examiner*—Charles G. Freay
*Assistant Examiner*—Han L. Liu
(74) *Attorney, Agent, or Firm*—Armstrong, Westerman & Hattori, LLP

(57) ABSTRACT

It is an object of the present invention to provide a high-efficiency linear compressor in which even if a compression chamber is defined utilizing an inner space of the linear motor to reduce its size, an amount of heat transmitted from the linear motor to the compression chamber can be reduced by forming a space between the linear motor and a cylinder which defines the compression chamber. The linear compressor comprises a cylinder having a flange and a cylindrical portion supported in a hermetic vessel by a support mechanism, a piston movably supported in the cylindrical portion along an axial direction thereof, a spring member applying an axial direction to the piston, and a linear motor having a stator fixed to the flange of the cylinder and disposed around an outer periphery of the cylindrical portion and a moving member coupled to the piston, wherein a space is formed between the stator and the cylindrical portion.

10 Claims, 9 Drawing Sheets

LINEAR COMPRESSOR

BACKGROUND OF THE INVENTION (1) Field of the Invention

The present invention relates to a linear compressor for reciprocating a piston fitted in a cylinder by a linear motor to draw in, compress and discharge gas.

(2) Description of the Prior Art

In refrigeration cycle, HCFC refrigerants such as R22 are stable compounds and decompose the ozone layer. In recent years, HFC refrigerants begin to be utilized as alternative refrigerants of HCFCs, but these HPC refrigerants have the nature for facilitating global warming. Therefore, a study is started to employ HC refrigerants which do not decompose the ozone layer or largely affect global warming. However, since this HC refrigerant is flammable, it is necessary to prevent explosion or ignition so as to ensure safety. For this purpose, it is required to reduce the amount of refrigerant to be used as small as possible. On the other hand, the HC refrigerant itself does not have lubricity and is easily melted into lubricant. For these reasons, when the HC refrigerant is used, an oilless or oil pure compressor is required. A linear compressor in which a load applied in a direction perpendicular to an axis of its piston is small and a sliding surface pressure is small is known as a compressor which can easily realize oilless as compared with a reciprocal type compressor, a rotary compressor and a scroll compressor.

However, in the case of the linear compressor also, a sliding degree of the sliding surfaces between the cylinder and the piston affects the efficiency and durability of the linear compressor. Therefore, considerably complicated means is required for constituting an oilless linear compressor.

For example, U.S. Pat. No. 5,920,133 discloses a Stirling engine in which a pair of leaf springs are disposed on opposite ends of a linear motor, and a piston is slidably supported by the leaf springs. With this structure, even if a force for inclining the piston is applied to the piston by magnetic attraction force generated by the linear motor, the piston is less prone to be displaced in a diametrical direction thereof.

However, this structure has a problem that since the piston is disposed outside the pair of spring members, a moving member constituting the linear motor becomes longer in its axial direction, and it is difficult to reduce the linear motor in size.

On the other hand, in order to shorten the axial size, there is a linear motor in which a compression chamber is defined by disposing the spring member only on the opposite side of the compression chamber and utilizing an inner space of the linear motor.

With this structure, however, since the piston is supported only by the spring member on the opposite side of the compression chamber, a displacement of the piston in its diametrical direction is great, and a pressure on sliding surfaces of the piston and the cylinder is increased. Further, there is a problem that since the compression chamber is disposed in the vicinity of the linear motor, the compression chamber is prone to receive heat of the linear motor.

In view of the above circumstances, it is an object of the present invention to provide a high-efficiency linear compressor in which even if a compression chamber is defined utilizing an inner space of the linear motor to reduce its size, an amount of heat transmitted from the linear motor to the compression chamber can be reduced by forming a space between the linear motor and a cylinder which defines the compression chamber.

Further, it is another object of the invention to provide a linear compressor in which even if magnetic attraction force generated by a linear motor is applied to the piston, a pressure on sliding surfaces of the piston and the cylinder is prevented from being increased and the linear compressor can be reduced in size by supporting opposite ends of the piston by spring members disposed on the opposite ends of the linear motor through a connecting member.

To achieve the above objects, according to a first aspect of the present invention, there is provided a linear compressor comprising a cylinder having a flange and a cylindrical portion supported in a hermetic vessel by a support mechanism, a piston movably supported in the cylindrical portion along an axial direction thereof, a spring member applying an axial direction to the piston, and a linear motor having a stator fixed to the flange of the cylinder and disposed around an outer periphery of the cylindrical portion and a moving member coupled to the piston, wherein a space is formed between the stator and the cylindrical portion.

With the first aspect, since the space is formed between the stator and the cylindrical portion, heat from the linear motor is less prone to be transmitted to the refrigerant in the compression chamber defined in the cylinder, heat-receiving loss of the linear compressor is reduced and its efficiency is enhanced.

According to a second aspect of the invention, in the linear compressor of the first aspect, the linear compressor further comprises a communication path which brings the space and outer peripheral regions of the cylinder and the linear motor.

With the second aspect, since the refrigerant in the space causes convection without being deposited, the heat-receiving loss is further reduced.

According to a third aspect of the invention, in the linear compressor of the second aspect, the communication path is formed in the flange. With the third aspect, high-temperature refrigerant in the space can efficiently be discharged to the outer peripheral regions of the cylinder and the linear motor and thus, the heat-receiving loss can be reduced.

According to a fourth aspect of the invention, there is provided a linear compressor comprising a cylinder having a flange and a cylindrical portion supported in a hermetic vessel by a support mechanism, a piston movably supported in the cylindrical portion along an axial direction thereof, a linear motor having a stator fixed to the flange of the cylinder and disposed around an outer periphery of the cylindrical portion and a moving member coupled to the piston, and a pair of spring members respectively disposed in the vicinity of the opposite ends of the linear motor and applying axial forces to the piston, wherein a space is formed between the stator and the cylindrical portion, and a communication member for bringing the moving member and the spring member closer to the flange is disposed in the space. With this arrangement, the heat from the linear motor is less prone to be transmitted to the refrigerant in the compression chamber defined in the cylinder, and the linear compressor can be reduced in size as compared with that of the first embodiment.

According to a fifth aspect of the invention, in the linear compressor of the first or fourth aspect, the spring member comprises a substantially C-shaped plate, the plate is disposed such that a distance between one end of the plate to a phantom center thereof is different from a distance between the other end of the plate to the phantom center. When the spring members are press-formed, if the spring members are integrally formed into complicated shape, it is necessary to secure punching margins between the resilient portions. However, by dividing the resilient portions of the spring members into the substantially C-shaped plates and combining the plates, it is unnecessary to secure punching margins between the resilient portions, and a width of each plate of the resilient portion can be increased correspondingly. With this design, it is possible to enhance the strength of the spring members.

According to a sixth aspect of the invention, in the linear compressor of the fifth aspect, the plates are combined. By dividing the resilient portions of the spring members into the substantially C-shaped plates and combining the plates, it is unnecessary to secure punching margins between the resilient portions, and a width of each plate of the resilient portion can be increased correspondingly.

According to a seventh aspect of the invention, in the linear compressor of the fifth aspect, one end of the plate disposed closer to the phantom center is fixed to the moving member, and the other end of the plate is fixed to the stator. Therefore, a width of the resilient portion can be increased.

According to an eighth aspect of the invention, in the linear compressor of the fourth aspect, the spring members include a plurality of resilient portions spirally extending in a circumferential direction from a center, the pair of spring members are disposed and fixed such that extending directions of the resilient portions from the center are different from each other. With this arrangement, the directions of the diametrical displacement forces of the spring members do not coincide with each other, the diametrical displacement of the connected spring members can be reduced and thus, the sliding surface pressure between the outer peripheral surface of the piston and the inner peripheral surface of the cylinder can further be reduced. Therefore, mechanical loss of the linear compressor is reduced, its efficiency is enhanced, and the reliability is also enhanced.

According to a ninth aspect of the invention, in the linear compressor of the fourth aspect, the connecting member is made of non-magnetic material. Therefore, even if the connecting member reciprocates in the leaking magnetic field in the vicinity of the linear motor, iron loss such as eddy current is not generated, and this can contribute the enhancement of the efficiency of the linear compressor.

According to a tenth aspect of the invention, in the linear compressor of the fourth aspect, the connecting member is provided with a plurality of slits along its moving direction. Therefore, even if the connecting member reciprocates in the leaking magnetic field in the vicinity of the linear motor, iron loss such as eddy current is not generated, and this can contribute the enhancement of the efficiency of the linear compressor.

DESCRIPTION OF THE PREFERRED EMBODIMENTS

An embodiment of a linear compressor of the present invention will be explained based on the drawings below.

Figure 1:
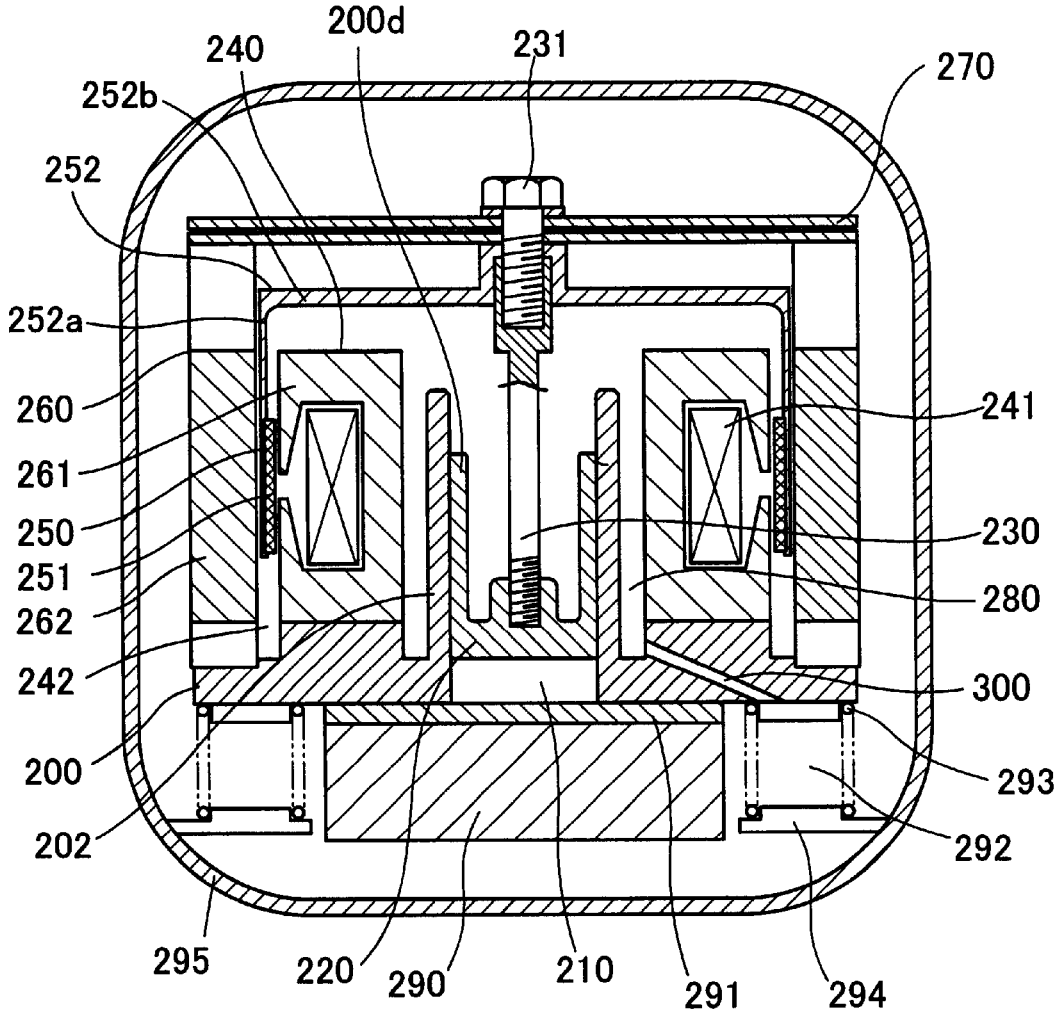
FIG. 1 is a sectional view showing an entire structure of a linear compressor of an embodiment of the present invention.

FIG. 1 is a sectional view showing an entire structure of the linear compressor of the embodiment of the present invention.

First, the entire structure of the linear compressor of this embodiment will be explained. This linear compressor essentially comprises a cylinder 200 supported by a support mechanism 292 in a hermetic vessel 295, a piston 220 slidably supported along an axial direction of the cylinder 200, a spring member 270 for applying an axial force to the piston 220, a linear motor 240 having a stator 260 fixed to the cylinder 200 and a moving member 250 supported in a reciprocating path formed in the stator 260 such that the moving member 250 can reciprocate, a rod-like member 230 connected to the piston 220, and a head cover 290 having a suction valve and a discharge valve for introducing and discharging refrigerant into and from a compression chamber 210 constituted by the cylinder 200 and the piston 220. One end of the rod-like member 230 is connected to the spring member 270, and the moving member 250 is also connected to the spring member 270. The piston 220 is disposed in an inner space of the linear motor 240 to form the compression chamber, thereby reducing the size of the linear compressor.

The hermetic vessel 295 comprises a vessel for accommodating the essential constituent elements of the linear compressor. Refrigerant is supplied into this vessel from a suction tube (not shown), and is introduced into a suction side of the head cover 290. The compressed refrigerant is discharged out from a discharge tube (not shown) which is in communication with outside of the hermetic vessel 295.

The support mechanism 292 comprises a spring-support plate 294 fixed in the hermetic vessel 295, and a plurality of coil springs 293 mounted on the spring-support plate 294 for supporting the cylinder 200. The coil springs 293 function to prevent vibration from being transmitted from the cylinder 200 to the hermetic vessel 295.

The cylinder 200 includes a flange 201 having a flat surface. The coil springs 293 abut against one end of the flange 201. The cylinder 200 is integrally formed with a cylinder portion 202 which projects toward the other end (upward as viewed in the drawings) from a center of the flange 201. An inner peripheral surface of the cylinder portion 202 is formed with a slide surface 200*d* against which the piston 220 abuts.

The piston 220 comprises a cylindrical body slidably supported by the slide surface 200*d* of the cylinder 200.

The spring member 270 comprises a plate-like member. When a periphery of the plate-like member is fixed, a portion thereof from the periphery to the center thereof is resiliently deformed.

The rod-like member 230 comprises a slim rod-like member, and one end thereof is connected to the piston 220 and the other end is fixed to the center of the spring member 270. This other end is connected to a detachable structure by a bolt 231 in this embodiment.

The linear motor 240 comprises the moving member 250 and the stator 260. The stator 260 comprises an inner yoke 261 and an outer yoke 262. The inner yoke 261 comprises a cylindrical body which is disposed at a predetermined distance from an outer periphery of the cylinder portion 202 of the cylinder 200 and fixed to the flange 201. With this arrangement, a space 280 is formed between the cylinder portion 202 and the inner yoke 261 in a longitudinal direction of the cylinder 200. The flange 201 is formed with a communication path which brings outer peripheral regions of the cylinder 200 and the linear motor 240 and the space 280. A coil 241 is accommodated in the inner yoke 261 and is connected to a power supply (not shown). On the other hand, the outer yoke 262 comprises a cylindrical body for covering the inner yoke 261, and is fixed to the flange 201 of the cylinder 200. Incidentally, a reciprocating path 242 having a small space is formed between the inner peripheral surface of the outer yoke 262 and the outer peripheral surface of the inner yoke 261. Further, a peripheral side of the spring member 270 is supported by and fixed to the outer yoke 262 in this embodiment.

The moving member 250 of the linear motor 240 comprises a permanent magnet 251 and a cylindrical holding member 252 for holding the permanent magnet 251. This cylindrical holding member 252 is accommodated in a reciprocating path 242 such that the holding member 252 can reciprocate therein, and comprises a peripheral edge 252*a* for fixing the permanent magnet 251 and a disc 252*b* which is integrally connected to the peripheral edge 252*a*. A center of the disc 252*b* is fixed to a center of the spring member 270. The permanent magnet 251 is disposed at a position opposed to the coil 241, and a fine gap is formed between the permanent magnet 251 and the coil 241. The inner yoke 261 and the outer yoke 262 are disposed concentrically with each other so as to hold the fine gap over the entire circumferential region uniformly.

The head cover 290 is fixed to an end surface side of the flange 201 of the cylinder 200 through a valve plate 291. A suction valve (not shown), a discharge valve (not shown) and the like which can be in communication with the compression chamber 210 are assembled in the valve plate 291, and these valves are connected to a suction-side space (not shown) and a discharge-side space (not shown) both provided in the head cover 290.

Next, operation of the linear compressor of the above structure will be explained. First, if the coil 241 of the inner yoke 261 is energized, magnetic force which is proportional to the current is generated as thrust between the moving member 250 and the permanent magnet 251 in accordance with Fleming's left-hand rule. A driving force is applied to the moving member 250 for moving the moving member 250 in its axial direction by this generated thrust. Since the cylindrical holding member 252 of the moving member 250 is connected to the spring member 270 together with the rod-like member 230, the piston 220 moves. The coil 241 is energized with sine wave, and thrust in the normal direction and thrust in the reverse direction are alternately generated in the linear motor. By the alternately generated thrust in the normal and thrust in the reverse direction, the piston 220 reciprocates.

The refrigerant is introduced from the suction tube into the hermetic vessel 295. The refrigerant introduced into the hermetic vessel 295 enters the compression chamber 210 from the suction-side space of the head cover 290 through the suction valve assembled into the valve plate 291. Further, the refrigerant is compressed by the piston 220 and discharged out from the discharge tube through the discharge valve assembled into the valve plate 291 and the discharge-side space of the head cover 290. Furthermore, vibration of the cylinder 200 caused by a reciprocating motion is restrained by the coil springs 293.

As explained above, according to the present embodiment, since the space 280 is formed between the inner yoke 261 forming the stator 260 of the linear motor 240 and the cylinder portion 202 of the cylinder 200, heat from the linear motor 240 is less prone to be transmitted to the refrigerant in the compression chamber 210 defined in the cylinder 200, heat-receiving loss of the linear compressor is reduced and its efficiency is enhanced. Further, since a communication path 300 is provided in the flange 201 of the cylinder 200, the refrigerant in the space 280 causes convection without being deposited, and the heat-receiving loss is further reduced.

Next, another embodiment of the present invention will be explained with reference to FIG. 2.

Figure 2:
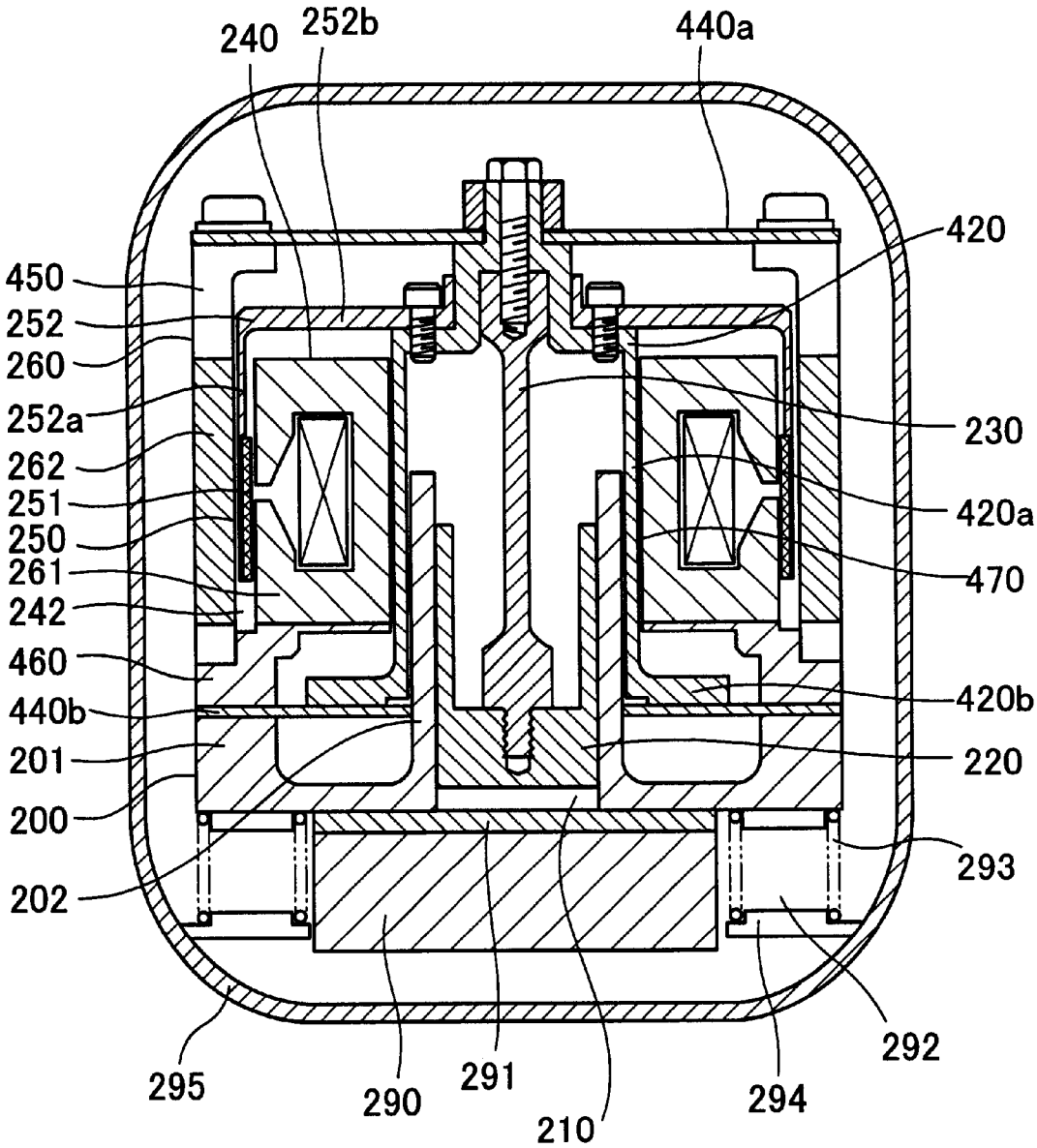
FIG. 2 is a sectional view showing an entire structure of a linear compressor of another embodiment of the invention.

FIG. 2 is a sectional view showing an entire structure of a linear compressor of another embodiment of the invention. The same members explained in the above embodiment are designated with the same numbers, and explanation thereof is omitted.

Spring members 440*a* and 440*b* comprise plate-like members. Peripheral edges of the spring members 440*a* and 440*b* are respectively supported by and fixed to a mount 450 (upper one in FIG. 2) and a mount 460 (lower one in FIG. 2) which are disposed on opposite side ends of the outer yoke 262 forming the linear motor 240.

The inner yoke 261 forming the linear motor 240 comprises a cylindrical body. The inner yoke 261 is separated from the cylinder portion 202 of the cylinder 200 by a predetermined distance and fixed to the mount 460. With this arrangement, a space 470 is formed in the longitudinal direction. Incidentally, the outer yoke 262 comprises a cylindrical body covering the inner yoke 261, and is fixed to the mount 460. Incidentally, in order to form a uniform fine gap between the outer yoke 262 and the inner yoke 261, the outer yoke 262 and the inner yoke 261 are disposed concentrically with each other on the mount 460.

The flange 201 of the cylinder 200 is fixed to and held by the mount 460. Further, the piston 220 comprising a slidably supported cylindrical body is disposed in the inner peripheral portion of the cylinder portion 202.

Figure 3:
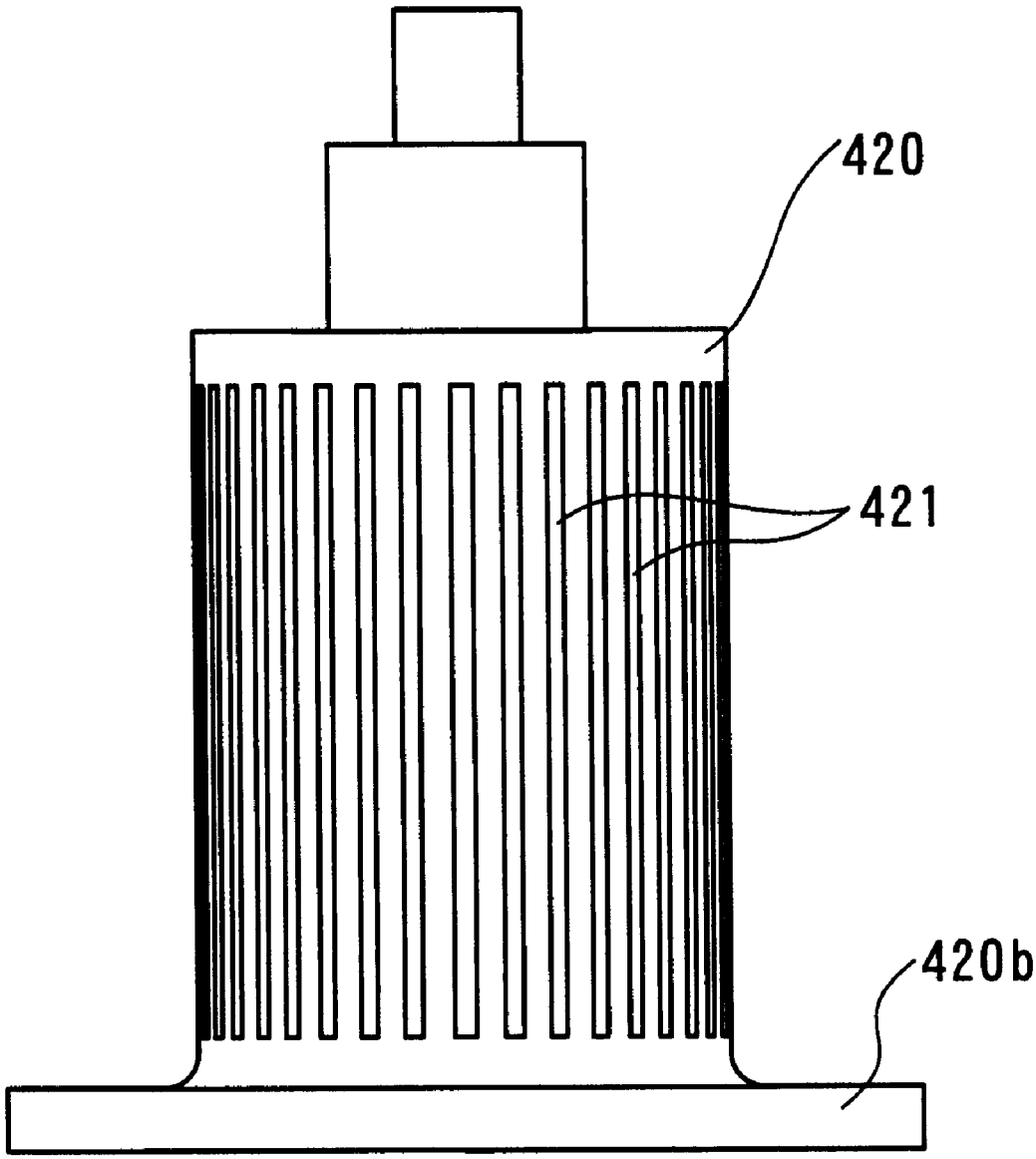
FIG. 3 is a side view of a connecting member of the embodiment of the invention.

The connecting member 420 comprises a cylindrical member 420*a* accommodated in the space 470 such that the rod-like member 230 can reciprocate therein. One end (upper end in FIG. 2) of the connecting member 420 is connected and fixed to a spring member 440*a* at a center portion thereof, and the other end (lower end in FIG. 2) of the connecting member 420 is formed with a flange 420*b* and an resiliently deformed end of the spring member 440*b* is fixed to the other end. The piston 220 is fixed to and supported by a center of a connecting member 420 through the rod-like member 230. The moving member 250 of the linear motor 240 and the connecting member 420 are connected and fixed to each other at their central portions. In this embodiment, material of the connecting member 420 is non-magnetic material such as aluminum and stainless steel. As shown in a side view of FIG. 3, the connecting member 420 is provided with a plurality of slits 421 along a moving direction of the connecting member 420.

As explained above, the connecting member 420 connecting the spring members 440*a* and 440*b* respectively disposed in the vicinity of the opposite ends of the linear motor 240 connects and supports the piston 220. Therefore, the opposite ends of the piston 220 are supported through the connecting member 420, and even if magnetic attraction force is applied to the piston 220, the outer peripheral surface of the piston 220 is not pushed against the inner peripheral surface of the cylinder portion 202 of the cylinder 200, and the sliding surface pressure of the sliding surface is reduced. With this arrangement, mechanical loss of the linear compressor is reduced, and its efficiency is enhanced, and the reliability is also enhanced. Further, the longitudinal space 470 is formed between the inner yoke 261 of the linear motor 240 and the cylinder portion 202 of the cylinder 200, the connecting member 420 for connecting the spring member 440*a* and the spring member 440*b* with each other is accommodated in the space 470 and thus, the compression chamber 210 can be formed utilizing the inner space of the linear motor 240. With this arrangement, the linear compressor can be reduced in size in addition to the effect of the first embodiment.

Furthermore, since the connecting member 420 is provided with the plurality of slits 421 as the non-magnetic materials, even if the connecting member 420 reciprocates in the leaking magnetic field in the vicinity of the linear motor 240, iron loss such as eddy current is not generated, and this can contribute the enhancement of the efficiency of the linear compressor.

Figure 4:
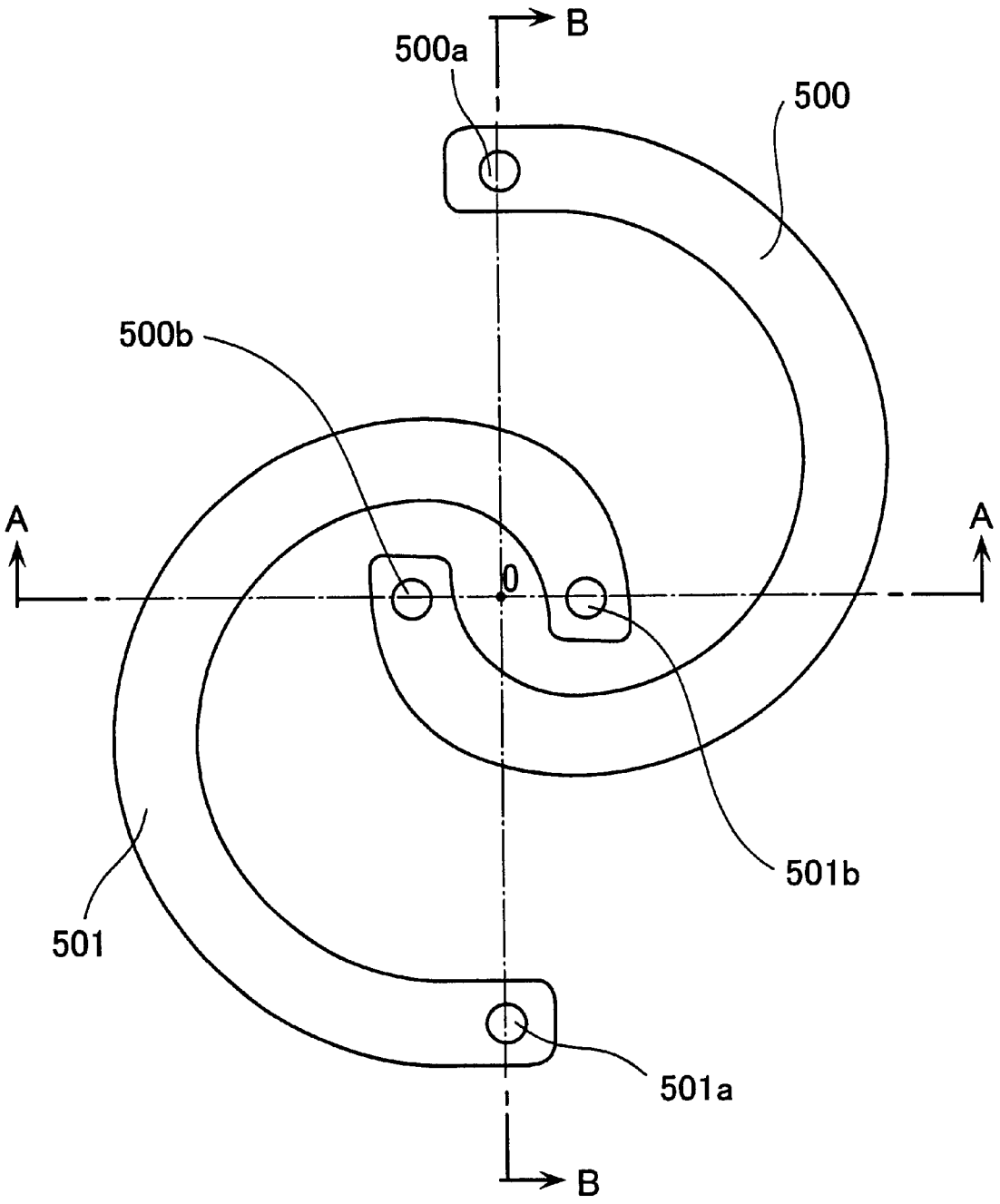
FIG. 4 is a plan view of spring member of the embodiment of the invention.

FIG. 4 is a plan view of a spring member of another embodiment of the present invention.

The spring members shown of this embodiment comprise substantially C-shaped plates 500 and 501 combined such as to spirally extend from a phantom center 0 in the circumferential direction. One of outer peripheral ends 500*a* and 501*a* and one of inner peripheral ends 500*b* and 501*b* are fixed to stators and the other ones are fixed to reciprocating members so that the plates 500 and 501 are resiliently deformed.

When the spring members are press-formed, if the resilient members are integrally formed into complicated shape, it is necessary to secure punching margins between the resilient portions. However, by dividing the resilient portions of the spring members into the substantially C-shaped plates 500 and 501 and combining the plates, it is unnecessary to secure punching margins between the resilient portions, and a width of each plate of the resilient portion can be increased correspondingly. With this design, it is possible to enhance the strength of the spring members.

Figure 5:
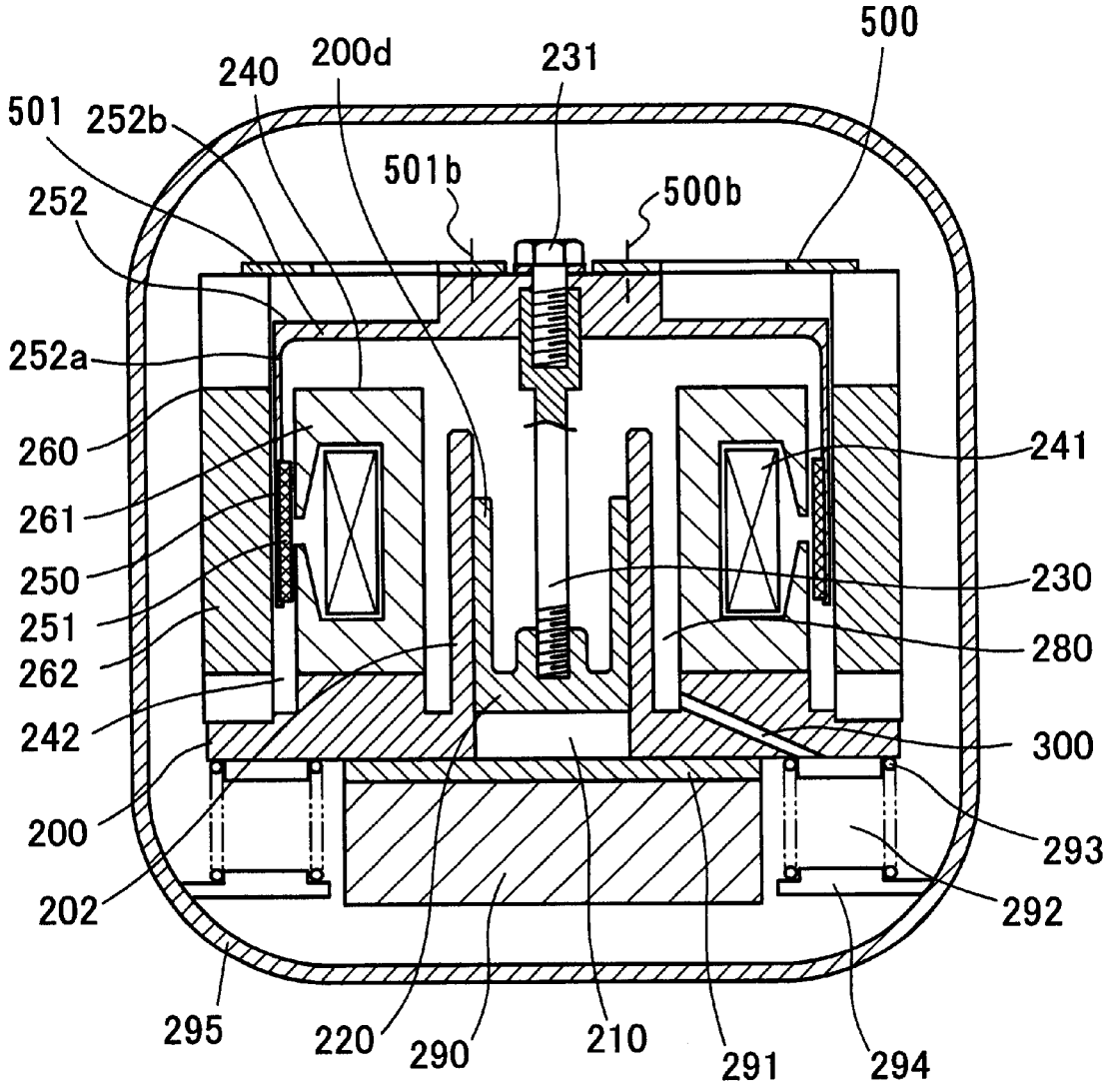
FIG. 5 is a sectional view taken along a line A—A in FIG. 4 showing an entire structure of a linear compressor according to another embodiment when the spring members shown in FIG. 4 are replaced by a spring member 270 in an embodiment shown in FIG. 1.
Figure 6:
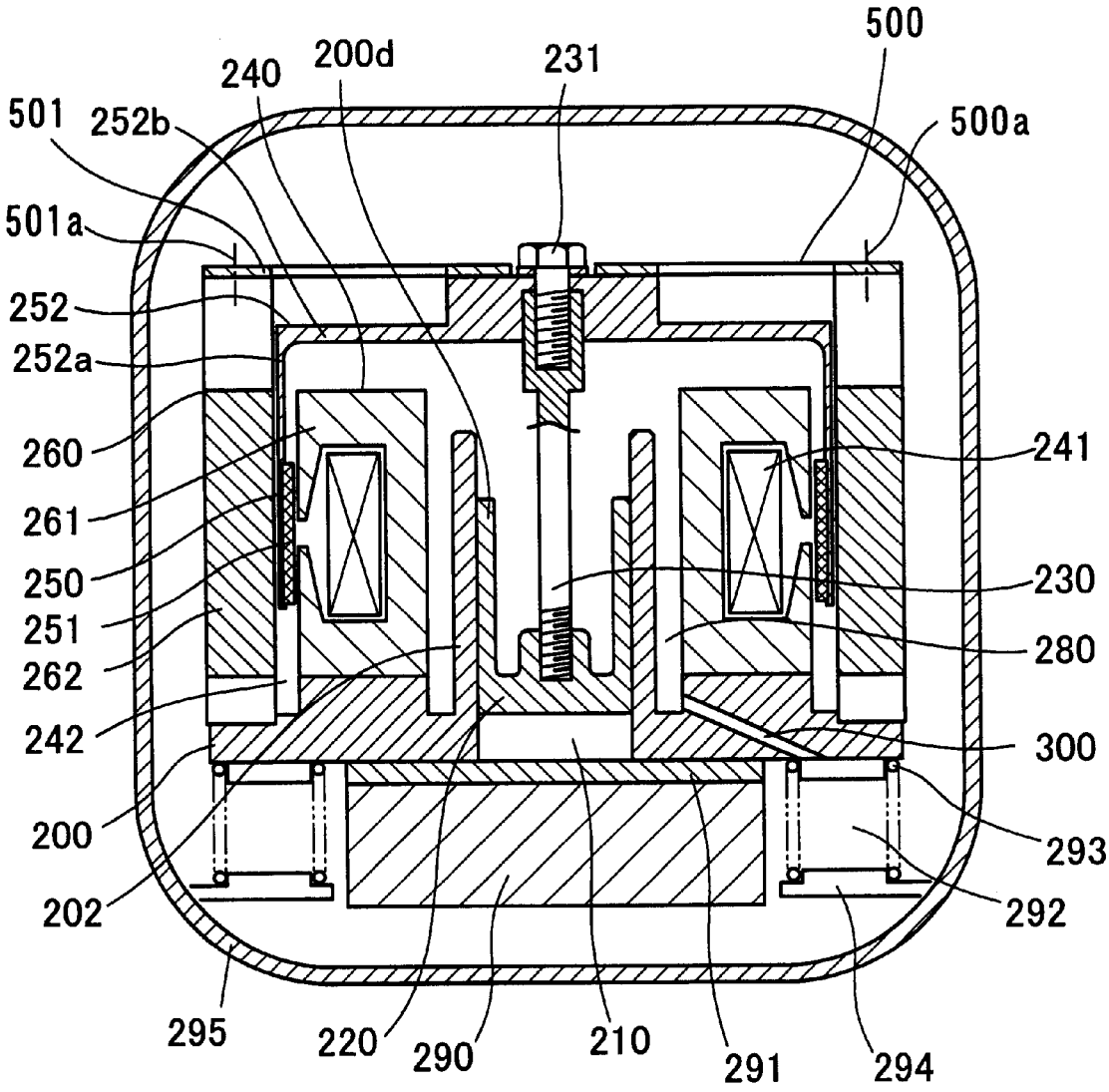
FIG. 6 is a sectional view taken along a line B—B in FIG. 4 showing an entire structure of a linear compressor according to another embodiment when the spring members shown in FIG. 4 are replaced by the spring member 270 in the embodiment shown in FIG. 1.

FIGS. 5 and 6 are sectional views showing an entire structure of a linear compressor according to another embodiment in which the spring member shown in FIG. 4 is used in place of the spring member 270 of the embodiment shown in FIG. 1. FIG. 5 is the sectional view taken along a line A—A in FIG. 4, and FIG. 6 is the sectional view taken along a line B—B in FIG. 4.

Figure 7:
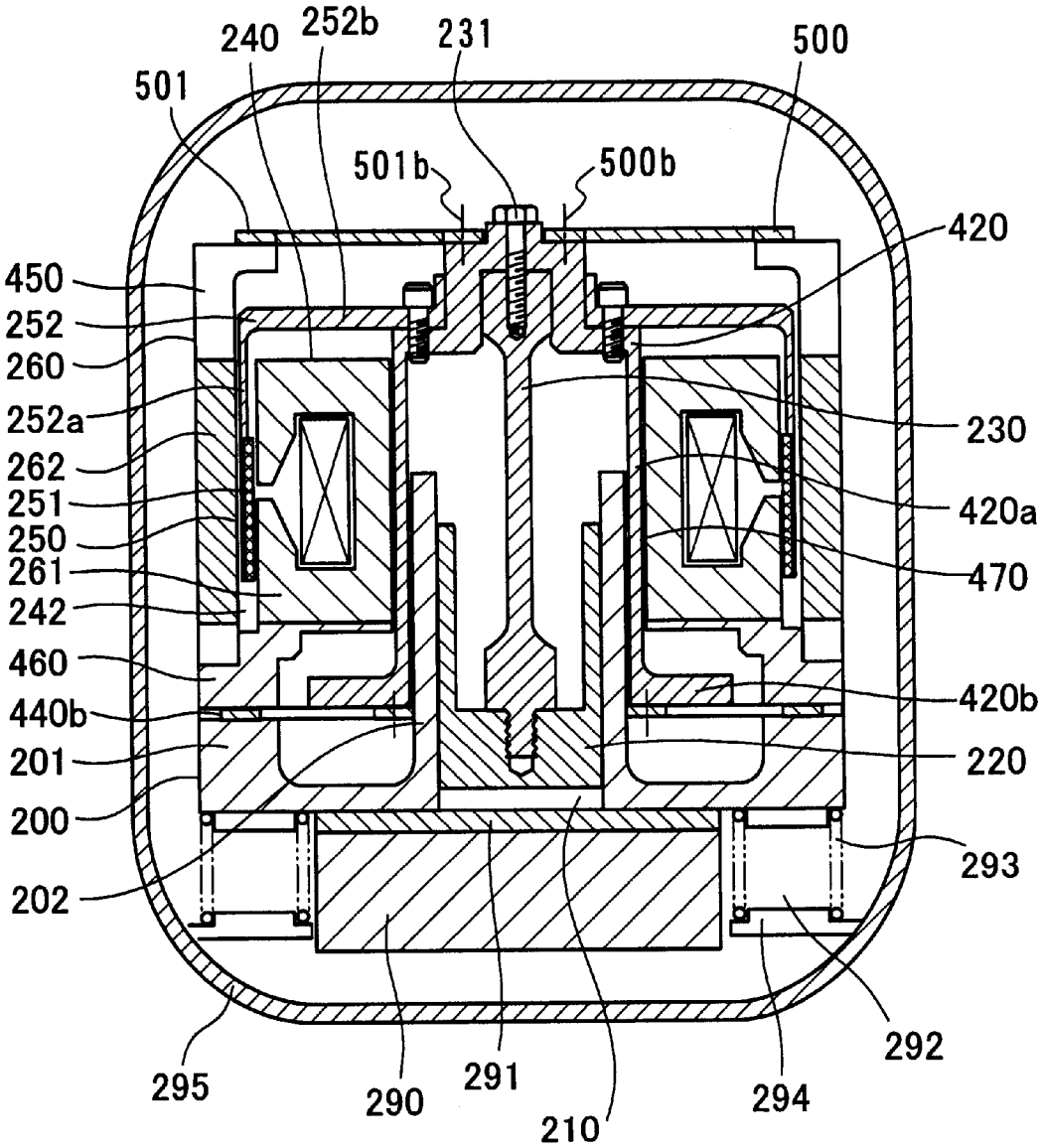
FIG. 7 is a sectional view taken along a line A—A in FIG. 4 showing an entire structure of a linear compressor according to another embodiment when the spring members shown in FIG. 4 are replaced by spring members 440*a* and 440*b* in an embodiment shown in FIG. 2.
Figure 8:
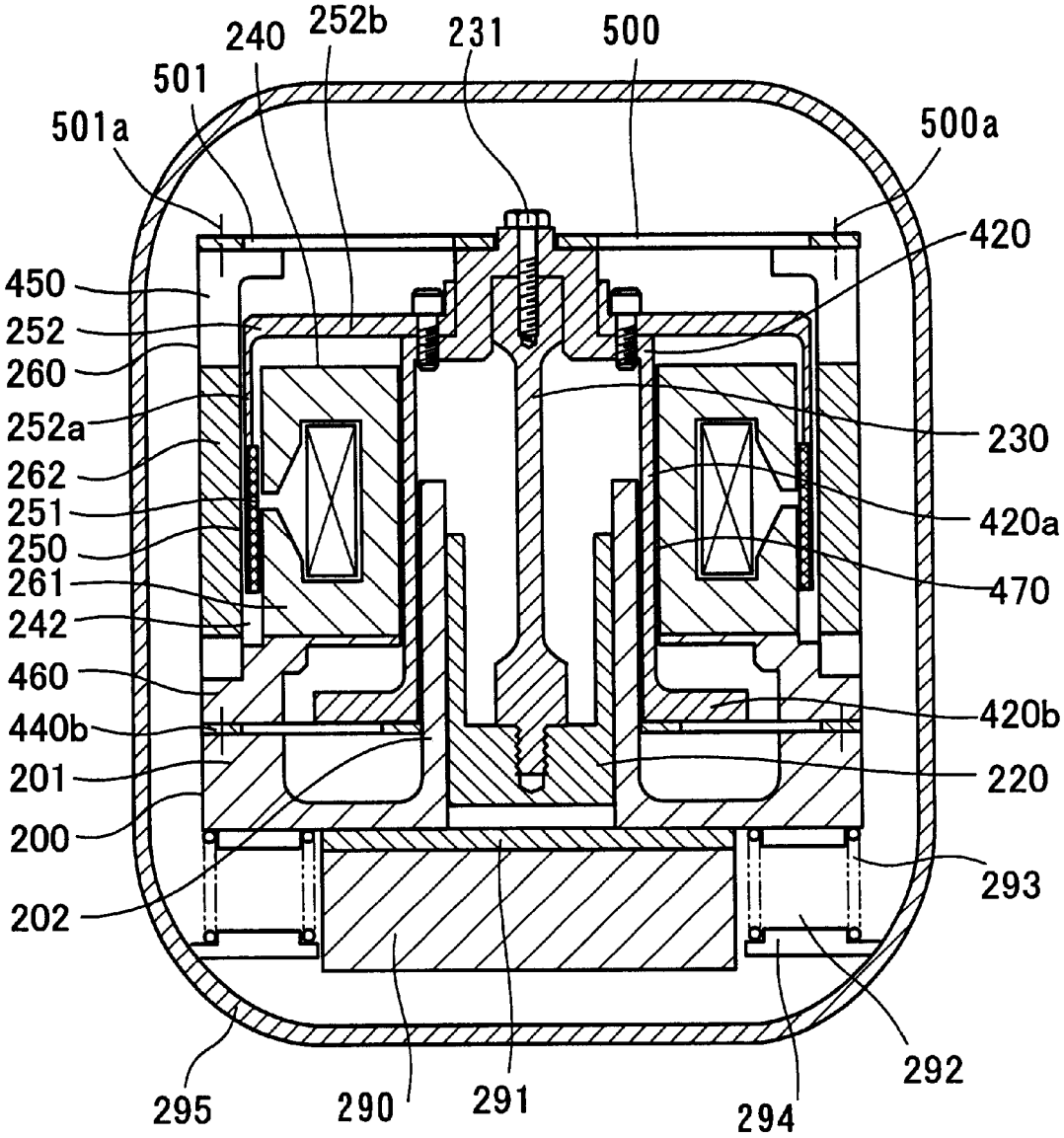
FIG. 8 is a sectional view taken along a line B—B in FIG. 4 showing an entire structure of a linear compressor according to another embodiment when the spring members shown in FIG. 4 are replaced by spring members 440*a* and 440*b* in an embodiment shown in FIG. 2.

FIGS. 7 and 8 are sectional views showing an entire structure of a linear compressor according to another embodiment in which the spring member shown in FIG. 4 is used in place of the spring members 440*a* and 440*b* of the embodiment shown in FIG. 2. FIG. 7 is the sectional view taken along a line A—A in FIG. 4, and FIG. 8 is the sectional view taken along a line B—B in FIG. 4.

The same members explained in the above embodiment are designated with the same numbers, and explanation thereof is omitted.

Figure 9A:
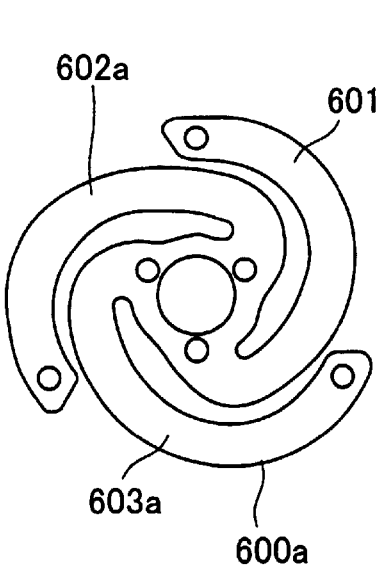
FIGS. 9A–C are views showing spring members and layout plans of the embodiment of the invention.
Figure 9B:
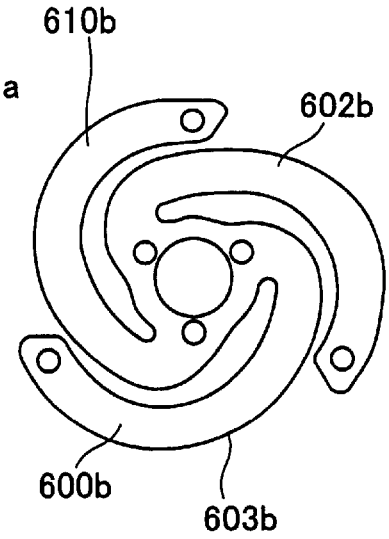
Figure 9C:
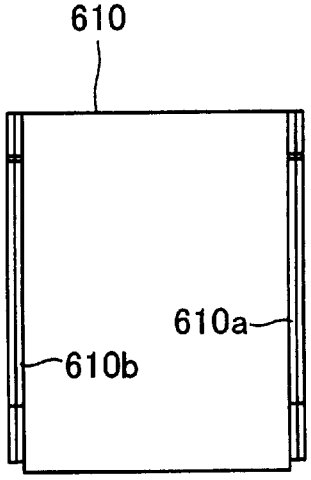

FIGS. 9A–C are views of a spring member and its arrangement thereof according to another embodiment of the present invention.

The spring member shown in FIG. 9 comprises a spring member 600*a* and a spring member 600*b*. The spring member comprises a spring member 600*a* and a spring member 600*b*. The spring member 600*a* includes resilient portions 601*a*, 602*a* and 603*a* which spirally extend in the circumferential direction. The spring member 600*a* is fixed to one end 610*a* of a linear motor 610. The spring member 600*b* includes resilient portions 601*b*, 602*b* and 603*b* which spirally extend in the circumferential direction such that their extending directions from the center of the resilient portions do not coincide with each other. The spring member 600*b* is disposed on and fixed to the other end 610*b*. In this embodiment, the resilient portions are disposed such that they are symmetric with each other with respect to a vertical axis. With this arrangement, directions of diametrically displacement forces of the spring members 600*a* and 600*b* do not coincide with each other, the diametrical displacement of the connected spring members 600*a* and 600*b* can be reduced and thus, the sliding surface pressure between the outer peripheral surface of the piston and the inner peripheral surface of the cylinder can further be reduced. Therefore, mechanical loss of the linear compressor is reduced, its efficiency is enhanced, and the reliability is also enhanced.

The spring members of this embodiment can be applied to the structure of the linear compressor shown in FIG. 2, but only one of the spring members 600*a* and 600*b* can also be applied to the structure of the linear compressor shown in FIG. 1.

According to the present invention, since the space is formed between the stator of the linear motor and the cylindrical portion of the cylinder, heat from the linear motor is less prone to be transmitted to the refrigerant in the compression chamber defined in the cylinder, the heat receiving loss of the linear compressor is reduced, and its efficiency is enhanced.

According to the invention, since the communication path is formed in the flange of the cylinder, the refrigerant causes convection without being deposited, and the heat-receiving loss is further reduced.

Further, according to the invention, the connecting member for connecting the spring members disposed in the vicinity of the opposite ends of the linear motor connects and supports the piston. Therefore, the opposite ends of the piston are supported through the connecting member, and even if magnetic attraction force is applied to the piston, the outer peripheral surface of the piston is not pushed against the inner peripheral surface of the cylinder portion of the cylinder, and the sliding surface pressure of the sliding surface is reduced. With this arrangement, mechanical loss of the linear compressor is reduced, and its efficiency is enhanced, and the reliability is also enhanced. Further, the connecting member for connecting the spring members with each other is accommodated in the space formed between the stator of the linear motor and the cylindrical portion of the cylinder and thus, the compression chamber can be formed utilizing the inner space of the linear motor. With this arrangement, the linear compressor can further be reduced in size.

Further, according to the present invention, by dividing the resilient portions of the spring members into the substantially C-shaped plates and combining the plates such as to spirally extend from the phantom center into the circumferential direction, it is unnecessary to secure punching margins between the resilient portions at the time of the press-forming, and a width of each plate of the resilient portion can be increase at the time of the press-forming correspondingly. With this design, it is possible to enhance the strength of the spring members.

Further, according to the present invention, the spring members having the plurality of resilient portions extending spirally in the circumferential direction are disposed and fixed such that their extending directions from the center of the resilient portions are different. Therefore, the directions of the diametrical displacement forces of the spring members do not coincide with each other, the diametrical displacement of the connected spring members can be reduced and thus, the sliding surface pressure between the outer peripheral surface of the piston and the inner peripheral surface of the cylinder can further be reduced. Therefore, mechanical loss of the linear compressor is reduced, its efficiency is enhanced, and the reliability is also enhanced.

Further, according to the invention, since the connecting member is made of non-magnetic material or is provided with the plurality of slits, even if the connecting member reciprocates in the leaking magnetic field in the vicinity of the linear motor, iron loss such as eddy current is not generated, and this can contribute the enhancement of the efficiency of the linear compressor.

What is claimed is:

1. A linear compressor comprising a cylinder having a flange and a cylindrical portion supported in a hermetic vessel by a support mechanism, a piston moveably supported in said cylindrical portion along an axial direction thereof a spring member applying spring force in an axial direction to said piston, and a linear motor having a stator fixed to the flange of said cylinder and disposed around an outer periphery of said cylindrical portion and moving member coupled to said piston, wherein a space is formed between an inner yolk and an outer yolk.

2. A linear compressor according to claim 1, further comprising a communication path communicating said space and an outer peripheral region of said cylinder and an outer peripheral region of said linear motor.

3. A linear compressor according to claim 2, wherein said communication path is formed in said flange.

4. A linear compressor according to claim 1, wherein said spring member comprises a substantially C-shaped plate, said plate is disposed such that a distance between one end of said plate to a phantom center thereof is different from a distance between the other end of said plate to said phantom center.

5. A linear compressor according to claim 4, wherein said plates are combined.

6. A linear compressor according to claim 4, wherein one end of said plate disposed closer to the phantom center is fixed to said moving member, and the other end of said plate is fixed to said stator.

7. A linear compressor comprising a cylinder having a flange and a cylindrical portion supported in a hermetic vessel by a support mechanism, a piston movably supported in said cylindrical portion along an axial direction thereof a linear motor having a stator fixed to the flange of said cylinder and disposed around an outer periphery of said cylindrical portion and a moving member coupled to said piston, and a pair of spring members respectively disposed in the vicinity of the opposite ends of said linear motor and applying axial forces to said piston, wherein a space is formed between said stator and said cylindrical portion, and a communication member is disposed in said space.

8. A linear compressor according to claim 7, wherein said spring members include a plurality of resilient portions spirally extending in a circumferential direction from a center, said pair of spring members are disposed and fixed such that extending directions of said resilient portions from the center are different from each other.

9. A linear compressor according to claim 7, wherein said connecting member is made of non-magnetic material.

10. A linear compressor according to claim 7, wherein said connecting member is provided with a plurality of slits along its moving direction.

* * * * *